US006132090A

United States Patent [19]

Hashimoto

[11] Patent Number: 6,132,090

[45] Date of Patent: Oct. 17, 2000

[54] CONTAINER

[75] Inventor: Kimiyuki Hashimoto, Kanagawa, Japan

[73] Assignee: Nippon Unicar Company Limited, Japan

[21] Appl. No.: 09/366,700

[22] Filed: Aug. 2, 1999

[30] Foreign Application Priority Data

Sep. 4, 1998 [JP] Japan ..... 10-250600

[51] Int. Cl.[7] ..... B65D 33/16

[52] U.S. Cl. ..... 383/67; 383/24; 383/71; 383/105; 383/121.1; 383/202; 141/114; 141/330

[58] Field of Search ..... 383/67, 41, 202, 383/22, 105, 119, 121.1, 24, 71; 141/114, 330; 312/1

[56] References Cited

U.S. PATENT DOCUMENTS

| | | | |
|---|---|---|---|
| 3,961,655 | 6/1976 | Nattrass et al. | 383/67 X |
| 4,211,266 | 7/1980 | Massey | 383/67 X |
| 4,966,311 | 10/1990 | Taylor . | |
| 5,121,776 | 6/1992 | Kovach | 141/114 X |
| 5,320,145 | 6/1994 | Avino | 141/114 X |
| 5,735,321 | 4/1998 | Matyn et al. | 141/114 X |
| 5,743,313 | 4/1998 | Josefsson | 141/330 |
| 5,944,070 | 8/1999 | Schmidt et al. | 141/114 |

FOREIGN PATENT DOCUMENTS

| | | |
|---|---|---|
| 0 709 300 | 5/1996 | European Pat. Off. . |
| 0 835 829 A1 | 4/1998 | European Pat. Off. . |

*Primary Examiner*—Jes F. Pascua
*Attorney, Agent, or Firm*—Banner & Witcoff, Ltd.

[57] ABSTRACT

A container, a container receiving sleeve cap and a process of unloading and receiving a filled material at a receiving facility that does not require expensive, exclusively specialized areas, such as clean rooms, for preventing the filled material from being contaminated or mixed with foreign matter when transported in a flexible and economic container. The container includes a double layer structure having an outer shell positioned about a flexible inner containing member, such as a bag. The process includes providing such a container having a blade cover with a tying member positioned at the lower surface of the container. The process also includes untying the tying member, positioning an outer shell unloading mouth away from the lower end of an inner bag unloading spout and securing it to an unloading frame receiving member. An inner bag unloading spout over-cover is then secured to an outer surface of a receiving sleeve. After the unloading spout over-cover has been secured, a sealed end of the inner bag unloading spout is opened using the container receiving sleeve cap and the filled material is unloaded and received in the receiving sleeve.

14 Claims, 3 Drawing Sheets

CONTAINER

BACKGROUND OF THE INVENTION

1. Field of the Invention

The present invention relates to a container and a method of unloading and receiving material from such a container. More particularly, The present invention relates to a container having an inner bag unloading mouth which prevents contamination and mixing of the filled material with foreign matters when the filled material is unloaded, a container receiving sleeve cap for receiving the filled material from the unloading mouth, and a process of unloading and receiving the filled material using the container and the sleeve cap.

2. Description of the Related Art

In the past, containers such as 25 kg package bags, 500 kg~3 metric ton flexible containers, 10~30 $m^3$ volume box type rigid containers, 500 kg~4 metric ton specialized metal containers and 10~20 metric ton specialized hopper cars have been utilized to store and transport large quantities of materials including pellets and powder. However, in recent years, the use of such storage containers has been questioned as a result of changing social circumstances that demand quality assurance and environmental conservation. For example, the use of package bags has created economic problems as a result of the labor costs associated with the filling, packing, opening and unloading of each individual bag. Environmental problems have also ben created by these bags. The environmental problems focus on the mass of package waste caused by the empty bags and the environmental effects of the treatment processes needed to dispose of the empty bags. Additionally, when these package bags are opened, foreign matter can mix with the contained material and contaminate it. As a result, the use of package bags also raises handling and contamination issues.

Filling specialized metal containers and specialized hopper cars using inert gases under pressure can prevent the filled material, such as pellets, from becoming contaminated by foreign matter during transportation. However, unless each container or hopper car is used only to carry one type of filling material, cross-contamination can still take place. By limiting each container or hopper car to only carrying one type of material, the versatility of the container or hopper car is significantly decreased while the number of them that must be constantly maintained is increased. In addition to the cost of these expensive containers, specialized unloading and receiving facilities with expensive equipment are required to avoid the contamination and mixing of the filled material with foreign matters during unloading.

Even though the 10~30 $m^3$ volume box type rigid containers can be used to transport generalized loads, inner bags must be positioned within each container to prevent cross contamination. These bags can increase the difficulties associated with loading and unloading the containers. For example, it is difficult to completely unload the filled material from a side face on the rear door of the container when an inner bag is used. Furthermore, as with the specialized metal containers and specialized hopper cars mentioned above, after being unloaded, the box type rigid containers are returned empty. The costs and labor required to return the empty containers make them economically impractical. This is especially true when the containers are used to export materials.

On the other hand, so-called flexible containers have been used because they are flexible, economically advantageous and able to function without an inner package bag. However, these flexible containers have problems with contamination and cross-contamination. However, in recent years, various improvements to flexible containers have been examined. For example, laid-open Japanese patent 10391/1996 discloses a flexible container having a double layer structure for preventing contamination and cross-contamination during transportation. The double layer structure includes a flexible inner bag positioned within an outer shell formed by a durable sheet material that is contamination-proof, oxidation-proof, and moisture-proof. The bag material can include a polyethylene film or a polyethylene laminated film.

Recently, a rigid one way container having an outer shell with a corrugated board or wooden frame has been used as an exporting container. This rigid container is similar to the above discussed flexible container, except the outer shell of the flexible container has been replaced by a rigid shell. These flexible and rigid one way containers are loaded on pallets that can be moved by general lifters and palleters. As a result, no specialized facility is required when these containers are received.

In the cases of pellets or other products which require high purity and minimal contamination during transportation, the flexible or rigid one way container mentioned above (both of these containers are hereinafter collectively referred to simply as "container" in this specification) are commonly filled in a plant that is well-equipped to control and prevent contamination during the filling process. However, there have been problems concerning contamination or mixing of the filled pellets with foreign matter while the pellets are being unloaded and received into a receiver tank after being transported to their final location. Therefore, it has been recommended to open and unload containers in a "clean room." However, even when a clean room is used, it is difficult to completely eliminate the dust that adheres to the outside of the containers during transportation. As a result, the clean rooms are not always effective. Additionally, the clean rooms need to be large-scale and require the construction of expensive facilities. Because of the costs associated with clean rooms, they have not been considered an economically feasible option.

Additional contamination problems can occur during the opening of the flexible inner bags. For example, when a pair of scissors are used for unsealing the unloading section of a sealed inner bag, cross-contamination with contaminants adhered to the scissors can occur. Additionally, metal fragments created by the friction between the cutting blades of the scissors may enter the inner bag and contaminate the contained material. This is especially troubling when the contained material includes plastic pellets for insulating electrical wires. If the metal fragments contaminate the plastic pellets, the performance of the wires can be adversely affected.

BRIEF DESCRIPTION OF THE INVENTION

The present invention overcomes the aforementioned problems that exist with the prior art. The present invention includes a container, a container receiving sleeve cap and a process of unloading and receiving a filled material at a receiving facility that does not require expensive, exclusively specialized areas, such as clean rooms, for preventing the filled material from being contaminated or mixed with foreign matter when transported in a flexible and economic container.

The container according to the present invention includes a double layer structure having an outer shell positioned about a flexible inner containing member. The outer shell includes a filling mouth proximate an upper surface of the container and an unloading mouth proximate a lower surface of the container. The flexible inner containing member includes an unloading mouth positioned within the unloading mouth of the outer shell. The unloading mouth of the flexible inner containing member also includes one or more recessed parts that extend inwardly for receiving the hands of an operator, a flexible inner containing member unloading spout and a flexible inner containing member unloading spout over-cover. The flexible inner containing member unloading spout over-cover is positioned inside the unloading mouth of the outer shell for circumferentially surrounding the unloading mouth spout of the flexible inner containing member.

The inner bag unloading mouth has a structure that prevents contamination that can occur with prior art containers as a result of foreign matters mixing with the filled material being unloaded. The container according to the present invention can be received so the filled material is isolated from the outside during discharge. As a result, the filled material is not mixed with foreign matters and contamination does not occur. The filled materials can be transported without using expensive, specialized containers that can only be returned in an empty condition. The present invention also does not have difficulty discharging the filled material. Moreover, using the container according to the present invention eliminates the need for expensive facilities, such as a clean room, etc. for unloading the filled material from the container. Instead the filled material can be unloaded and received by merely using common equipment such as cranes, lifters, palleters, etc. without contamination or mixing the filled material with foreign matters.

The present invention also includes a container receiving sleeve cap positioned on a receiving sleeve. The sleeve cap includes an opening device for receiving a container according to the present invention and unsealing the unloading spout of the flexible inner containing member so the filled material can be unloaded into the receiving sleeve. By unsealing the inner bag unloading spout with an opening device mounted on the receiving sleeve cap according to the present invention, cross-contamination and foreign matter contamination as a result of metal chips from scissors or other such opening devices are prevented.

The process for unloading and receiving a filled material from a container comprises providing a container according to the present invention having a blade cover with a tying member positioned at the lower surface of the container. The process also includes untying the tying member, positioning an outer shell unloading mouth and an inner containing member unloading spout over-cover within an unloading frame receiving sleeve of an unloading frame and securing a lower end of the outer shell unloading mouth to an outer surface of the unloading frame receiving sleeve. The process further includes positioning and fixing the unloading spout over-cover over an outer surface of a filled material receiving sleeve. After the unloading mouth over-cover has been sealed to the receiving sleeve, a lower end of the inner containing member unloading spout is unsealed and the filled material is unloaded and received into the receiving sleeve.

DETAILED DESCRIPTION OF THE INVENTION

Figure 1:
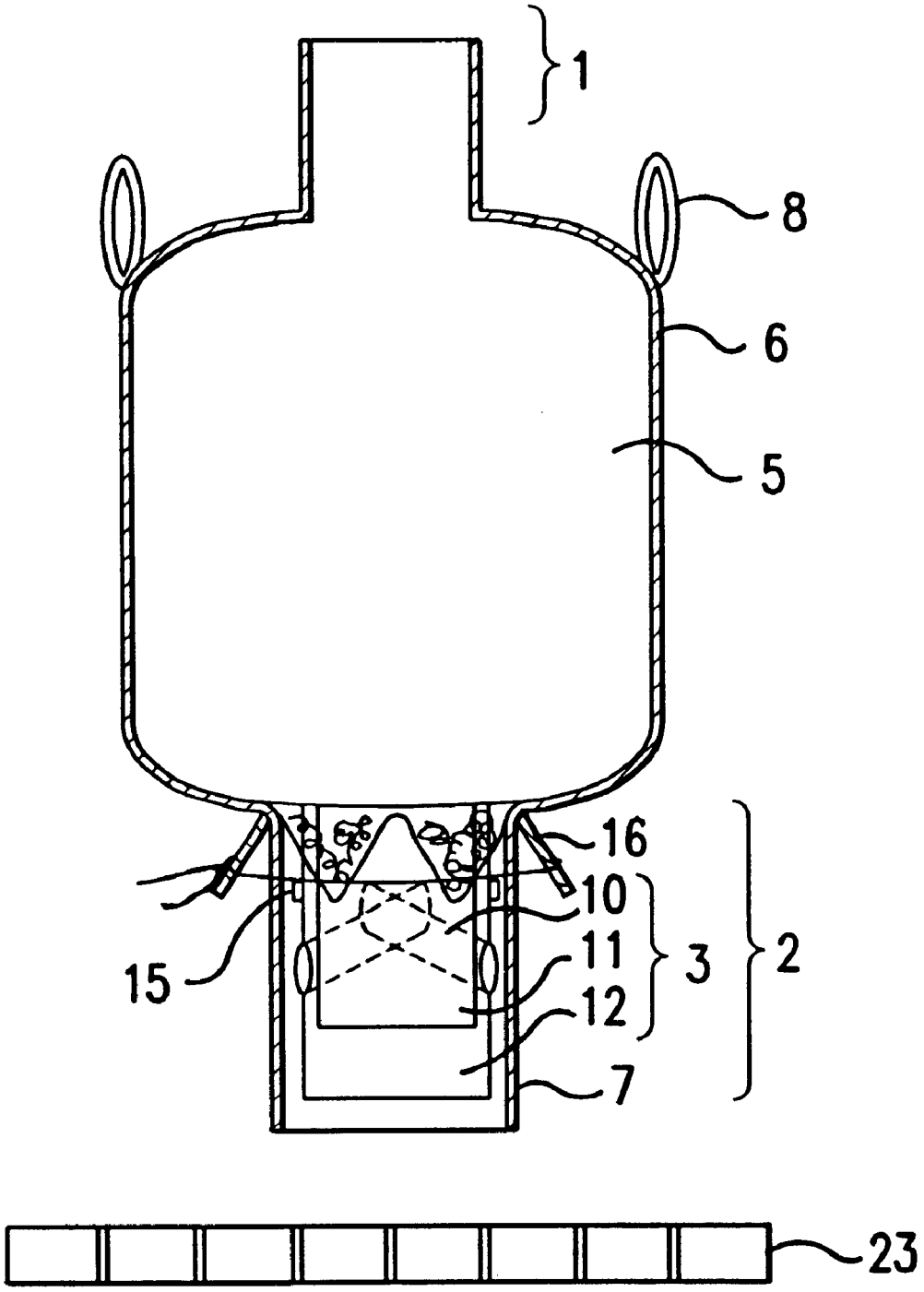
FIG. 1 is a side view showing a flexible container having a double layer structure with a flexible outer shell and a flexible inner bag according to the present invention.

FIG. 1 is a side view showing a flexible container of the present invention having a double layer structure with a flexible outer shell 6 and a flexible inner bag 5. The container includes a filling mouth 1 at its top surface and an unloading mouth 2 at its bottom surface. The unloading mouth 2 includes a blade cover 16 through which a tying member such as a rope, string or band is passed. The blade cover 16 also has a plurality of internal "V" shaped elements. The unloading mouth 2 also includes an outer shell unloading spout 7 and an inner bag unloading mouth 3. The inner bag unloading mouth 3 has an inner bag unloading spout 11 and an inner bag unloading spout over-cover 12 including one or more concave parts 10 having a shape that extends inward toward the middle of the inner bag unloading spout over-cover 12 so that the hands of an operator can be inserted therein. An inner bag tying part 15 is located at an upper section of the inner bag unloading spout over-cover 12. Inner bag tying part 15 includes a tying member such as a rope, string or band.

The outer shell unloading spout 7 and the blade cover 16 can be formed from the same sheet of material as the flexible outer shell 6. Alternatively, the outer shell unloading spout 7 and the blade cover 16 can be formed of separate materials and attached to the flexible outer shell 6 by heat-sealing, using adhesives or other well known processes. Blade cover 16 can be formed of a tough flexible material for protecting the outer shell unloading spout 7 and the inner bag unloading mouth 3. As shown in FIG. 1, blade cover 16 can be closed by its tying member.

The inner bag unloading spout over-cover 12 and the inner bag unloading spout 11 are formed of flexible materials. In a preferred embodiment, these flexible materials include heat sealable, thermoplastic resins that are preferably transparent. Transparent materials allow the attendant to see within the inner bag unloading spout 11 and the inner bag unloading spout over-cover 12 during unloading so he can effectively work the container while his hands are positioned in the concave parts 10 and monitor for contamination possibilities. The upper ends of the bag unloading spout 11 and the bag unloading spout over-cover 12 are fixed to the inner bag 5. The lower ends of the bag unloading spout 11 and the bag unloading spout over-cover 12 are sealed closed by heat-sealing, using adhesives or other well known techniques.

Each concave part 10 extends from an outer surface of inner bag spout over-cover 12 toward the inside of the inner bag unloading spout over-cover 12. The concave parts 10 are sealed together on three edges by heat-sealing, using adhesives or other well known techniques. The unsealed or open edge is also fixed to the inner bag unloading spout over-cover 12 by heat-sealing, using adhesives or other well known techniques. Each concave part 10 can have an envelope-like shape as shown in FIG. 1. Complicated shapes, such as that of a glove, are not necessary as the operator only needs to be able to perform simple tasks while his hands are positioned within the concave parts 10. These tasks include severing the lower end of the inner bag unloading spout 11 to unseal it, placing the severed piece and a receiving sleeve cap 31 along the circumference of a receiving sleeve 30, and inserting the lower end of the unsealed inner bag unloading spout 11 inside the receiving sleeve, as discussed hereinafter (see FIGS. 3 and 4). In a preferred embodiment, two or more concave parts 10 are included so that the operator can use both hands to easily operate the container. However, the container of the present invention can also be operated with only one concave part 10.

While the container is being filled with a material, the inner bag tying part 15 of the sealed inner bag unloading mouth 3 is tied using the associated tying member. After being tied, the section of the inner bag unloading mouth 3 below the inner bag tying part 15 is folded so that it is flat. The outer shell unloading spout 7 is then folded so that it wraps over the entire tied and folded inner bag unloading mouth 3. After the shell unloading spout 7 has been folded, the blade cover 16 is tied outside it. As a result, the bottom surface of the container is roughly flat during filling. After the container has been filled with the preferred material, the filling mouth 1 is sealed by a tying member such as a string, rope or other known devices and/or by heat-sealing, adhesion or other known processes.

A hanging accessory 8 having a belt, band, or other known device can be positioned on the upper part of the flexible outer shell 6 so that the container can be picked up by a crane or similar lifting device. For example, the container shown in FIG. 1 may be conveniently used during unloading and receiving of the filled material at the end user plant where a hanging facility includes a crane for cooperating with the hanging accessory 8.

The filling operation of the container may be conveniently carried out on a pallet 23. The pallet 23 may also be used to transport the container after it has been filled. In order to improve protection of the filled material during transportation, a wooden or corrugated board box may be placed between the container and the pallet 23, and a cover can be positioned over the top of the container. The corrugated board box can be positioned between the container and the pallet prior to or after the container is filled.

Figure 2:
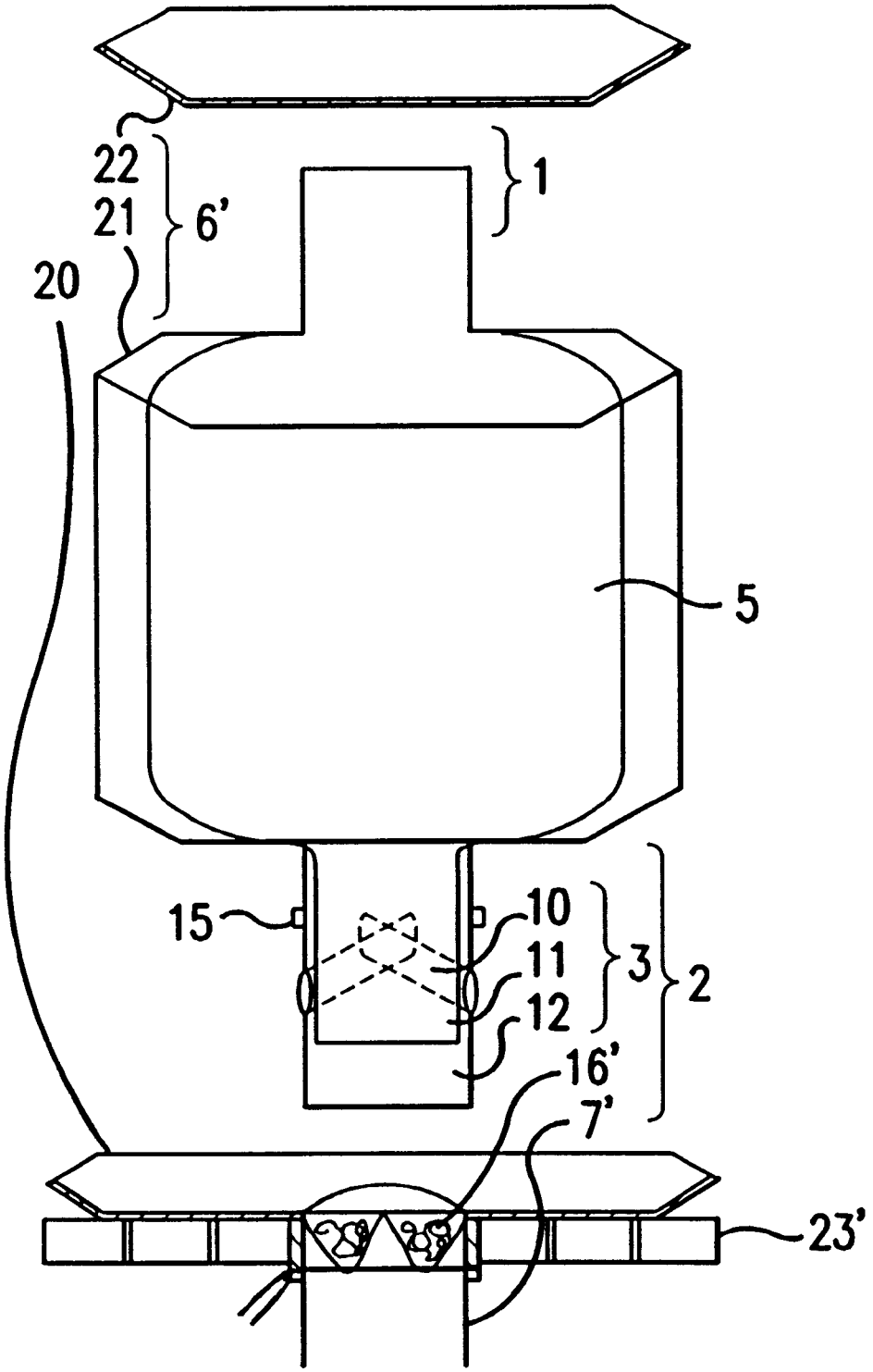
FIG. 2 is a side view showing a container having a double layer structure including a rigid outer shell and a flexible inner bag according to the present invention.

A container, as shown in FIG. 2, has a double layer structure including a rigid outer shell 6 and a flexible inner bag 5. The reference numerals indicate the same elements as discussed above with respect to FIG. 1, and a duplicate explanation of these elements will not be included. The container includes the filling mouth 1 at an upper end and the unloading mouth 2 at a lower end. In this embodiment, the constitution of the inner bag unloading mouth 3 is the same as that discussed above with respect to FIG. 1. Additionally, the bottom surface of the inner bag 5 is roughly flat when it has been tied and folded, as discussed above.

The rigid outer shell 6' includes a top plate 22, a base plate 20 and a side plate 21, all formed from a rigid material such as wood, synthetic resin, corrugated board or other known rigid materials. The rigid base plate 20 and the rigid side plate 21 are secured together as a box for containing the flexible inner bag 5. The rigid base plate 20 includes outer shell unloading spout 7' and a tied blade cover 16' positioned on a pallet 23' having a hole in its center. The inner bag 5 with the inner bag unloading mouth 3 is placed on the rigid base plate 20. Since the outer shell unloading spout 7' and the blade cover 16' are made of flexible materials which can be tied, they are fixed to the base plate 20 by adhesion, heat-sealing, or other well known processes.

The filling of the flexible inner bag 5 is suitably carried out on the pallet 23', and it is transported with the pallet by covering the open top of a rigid outer shell 6' with the rigid top plate 22. The rigid shell 6' is not limited to a specific shape such as a cube. Instead polygonal and circular cylinders can also be used. The container shown in FIG. 2 can be unloaded and received according to the process of the present invention even if machinery, such as a crane, is not available at the unloading and receiving plant.

Figure 3:
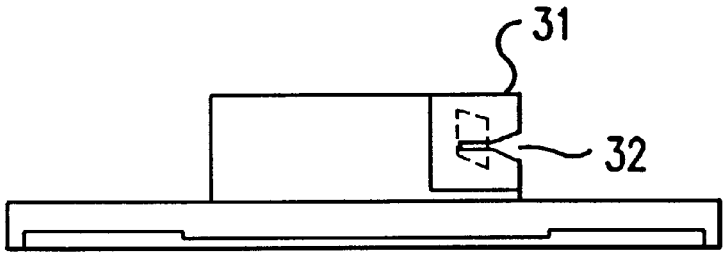
FIG. 3 is a side view of a receiving sleeve cap with an opening device for unsealing the container of the present invention.

FIG. 3 illustrates the receiving sleeve cap 31 including an opening device 32 for unsealing the container of the present invention. The opening device 32 is attached to the upper face of the receiving sleeve cap 31. When the filled material is unloaded from either of the containers shown in FIGS. 1 and 2, it is necessary to cut off the lower end of the inner bag unloading spout 11 to open its seal. If this is carried out by a pair of scissors, as commonly done, foreign matters stuck to the scissors and trace metal produced by the wearing of the cutting edges of the scissors can adhere to the unsealed area and may contaminate the filled material. In order to avoid such contamination, a device, such as the opening device 32 which includes a cutter blade, is mounted on the receiving sleeve cap 31. The opening device 32 operates in such a manner that the unsealed inner bag unloading spout 11 can be inserted within the receiving sleeve 30 without contaminating the filled material with foreign matter. The opening of unloading spout 11 is accomplished by a simple and easy operation during which one side of its lower end is placed into a gap provided by the opening device and it is pulled through the gap over the cutter blade. The cutter blade is mounted and fixed within the gap so that it cuts the unloading spout 11 on contact. The cutter blade could be formed of a metal because it is not rubbed with another blade so trace metal pieces will not be created. A ceramic cutter or a metal cutter coated with a synthetic resin which is inert to the filled material can also be used depending on the requirement. The receiving sleeve cap 31 according to the present invention is particularly suited for unsealing the inner bag unloading spout 11 of the container according to the present invention.

Figure 4:
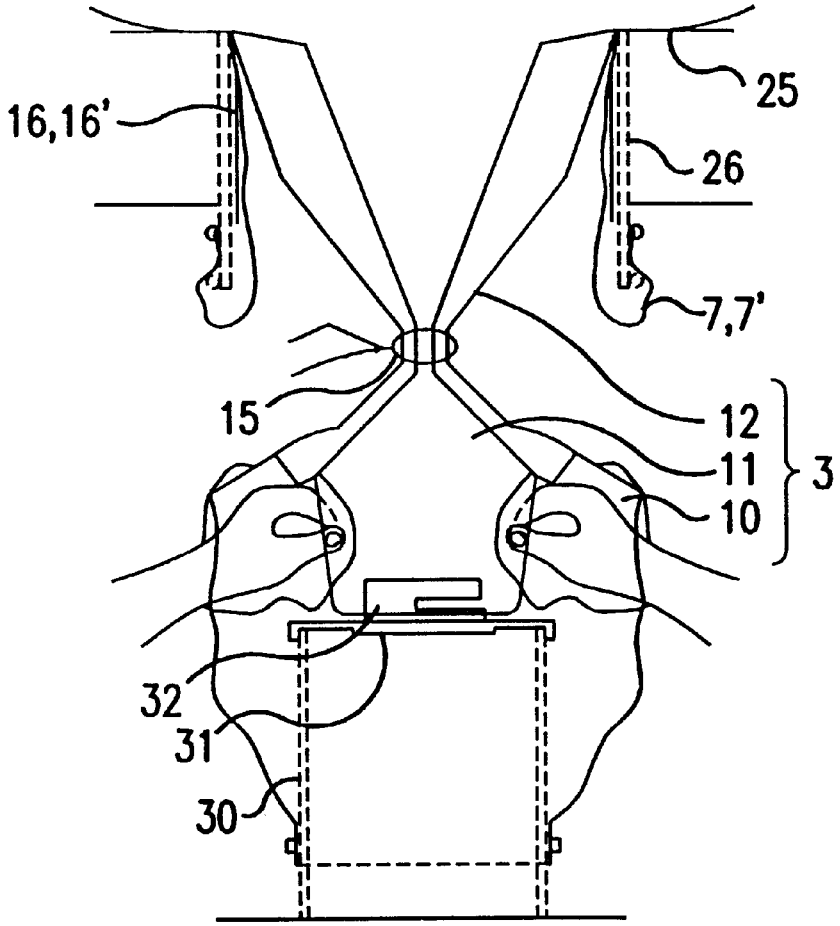
FIG. 4 is a partial side view of the container during the process of unloading and receiving a filled material within a receiving sleeve before the receiving sleeve cap has been removed.

FIG. 4 shows the blade cover 16, the outer shell unloading spout 7 and the inner bag unloading mouth 3 positioned with respect to an unloading frame 25 during the unloading and receiving process. As shown in FIG. 4, the filled material is unloaded from its container and received in the receiving sleeve 30. When the filled material is unloaded from the flexible container of FIG. 1, after being transported, hanging facilities, such as a crane, are used to position the container so that the unloading mouth 2 is located on an unloading frame receiving sleeve 26 of the unloading frame 25. With respect to the embodiment shown in FIG. 2, a lifter or palleter is used to move the pallet 23' and the rigid container in order to properly position the unloading mouth 2 relative to the unloading frame receiving sleeve 26. After proper positioning has been achieved between the unloading mouth 2 and the unloading frame receiving sleeve 26, the blade cover 16, 16' is untied and positioned along the unloading frame receiving sleeve 26. The outer shell unloading spout 7, 7' is then drawn up over the unloading spout over-cover 12, folded over a lower opening of the unloading frame receiving sleeve 26 and fixed tightly to the outer circumference of the unloading frame receiving sleeve 26 with a rubber band, string or other well known binding device. As a result of the positioning and binding of the unloading spout 7, 7', contamination of the filled material caused by foreign matter from the unloading frame 25 and pallet 23' may be controlled to some degree.

As shown in FIG. 4, the inner bag unloading spout over-cover 12 extends downward from the inner bag 5 through the unloading frame receiving sleeve 26 in the direction of the receiving sleeve 30. When the outer shell unloading spout 7 is secured to the unloading frame receiving sleeve 26, the inner bag unloading spout over-cover 12 extending between the unloading frame receiving sleeve 26 and the receiving sleeve 30 is exposed. A lower end of the inner bag unloading spout over-cover 12 is unsealed and tightly fixed to the outside of the receiving sleeve 30. This lower end is secured to the receiving sleeve 30 with a rubber band, string or other well known binding devices. This creates a working box isolated from the outside. A flange can be mounted on the outer circumference of the receiving sleeve 30 for supporting the discarded receiving sleeve cap 31 and piece cut from the inner bag unloading spout 11, as discussed below. The end part of the inner bag unloading spout over-cover 12 can also be fixed to the outer circumference of the flange.

After the inner bag unloading spout over-cover 12 has been secured to the receiving sleeve 30, the operator's hands are inserted in the concave parts 10 formed on the inner bag unloading spout over-cover 12, the fold of the inner bag unloading spout 11 is flattened, and one side of its lower end is put into the cutter containing gap of the opening device 32 mounted on the receiving sleeve cap 31. This lower end is then pulled through the gap and unsealed as it is cut. The resulting, severed piece of the inner bag unloading spout 11 is discarded into the space between the outer circumference of the receiving sleeve 30 and the inside of the inner bag unloading spout over-cover 12. The receiving sleeve cap 31 is then picked up, removed from the receiving sleeve 30 and placed in the same space along side the severed piece. Following the removal of the receiving sleeve cap 31, the unsealed inner bag unloading spout 11 is put into the receiving sleeve 30 and the inner bag tying part 15 untied so that the filled material is unloaded in the direction of the receiving sleeve 30 without the risks of contamination or mixing the filled material with foreign matters. While the filled material is being unloaded and received, the filling mouth 1 of the respective container can either be held or left unattended.

The containers according to the present invention are capable of carrying sensitive materials wherever a trace of contamination with foreign matters can cause performance deterioration of the entire contained product. Such materials can include, but are not limited to enumerated synthetic resins for scientific instruments, medical applications and wire applications.

The present invention is not limited by the above discussed embodiment. For example, the inner bag unloading spout over-cover 12 could be fixed to the upper end of the inner bag unloading spout 11 without fixing it directly to the inner bag 5. Furthermore, the flexible container shown in FIG. 1 could be packed and transported in the rigid outer shell 20 shown in FIG. 2.

While certain specific embodiments of the invention have been described with particularly herein, it will be recognized that various modifications thereof will occur to those skilled in the art and it is to be understood that such modifications and variations are to be included within the preview of this application and the spirit and scope of the appended claims.

What is claimed is:

1. A container for holding materials comprising:

a) an outer shell having a filling mouth and an unloading mouth, said outer shell being positioned about a flexible inner containing member;

b) said flexible inner containing member including an unloading mouth located within said outer shell unloading mouth, said inner containing member unloading mouth comprising:

1) an unloading spout having a lower end; and 2) a flexible unloading spout over-cover having one or more recessed parts extending toward a center of said inner containing member for receiving the hands of an operator, said unloading spout over-cover being positioned between said outer shell unloading mouth and said unloading spout for surrounding a circumference of said unloading spout.

2. The container according to claim 1, wherein the outer shell includes a rigid material for protecting said flexible inner containing member.

3. The container according to claim 2 wherein said rigid outer shell includes a cover, side walls and a base plate for surrounding and protecting said inner containing member.

4. The container according to claim 3 wherein said base plate includes a blade cover and a tying member for closing said outer shell unloading mouth, and wherein said base plate also includes said outer shell unloading mouth.

5. The container according to claim 3 wherein said flexible inner containing member is a bag.

6. The container according to claim 1, wherein the outer shell includes corrugated board.

7. The container according to claim 1, wherein the outer shell consists of a flexible material.

8. The container according to claim 1 further comprising handles for hanging said container during unloading of the held material.

9. The container according to claim 1 wherein said outer shell unloading mouth includes a blade cover and a tying member for closing said outer shell unloading mouth.

10. The container according to claim 1 wherein said flexible inner containing member is a bag.

11. A process for unloading and receiving a material from a filled container comprising the steps of:

(a) providing the container as claimed in claim 1, wherein a blade cover having a tying member is positioned at a lower surface of the container;

(b) untying said tying member of said blade cover;

(c) positioning the outer shell unloading mouth away from the lower end of the unloading spout and securing the outer shell unloading mouth to an unloading frame receiving member;

(d) positioning a portion of said unloading spout over-cover within the unloading frame receiving member;

(e) fixing said unloading spout over-cover to an outer surface of a receiving sleeve for receiving the filled material;

(f) unsealing the lower end of said inner containing member unloading spout; and (g) unloading and receiving the filled material into said receiving sleeve.

12. The process according to claim 11 further including the step of folding a lower end of said outer shell unloading mouth over an end of said unloading frame receiving member.

13. The process according to claim 11 wherein said step of unsealing the lower end of said inner containing member unloading spout includes contacting said lower end with an opening device on a receiving sleeve cap positioned on said receiving sleeve.

14. A container for holding materials in combination with a container receiving sleeve cap for positioning on said container, said container comprising:

a) an outer shell having a filling and an unloading mouth, said outer shell being positioned about a flexible inner containing member;

b) said flexible inner containing member including an unloading mouth located within said outer shell unloading mouth, said inner containing member unloading mouth comprising:

1) an unloading spout having a lower end; and 2) a flexible unloading spout over-cover having one or more recessed parts extending toward a center of said inner containing member for receiving the hands of an operator, said unloading spout over-cover being positioned between said outer shell unloading mouth and said unloading spout for surrounding a circumference of said unloading spout; and said container receiving sleeve cap comprising: a face including an opening device for receiving and unsealing the inner containing member unloading spout positioned within the outer shell of the container for unloading and receiving the filled material from the container.

* * * * *